US005867847A

United States Patent [19]

Klawitter et al.

[11] Patent Number: 5,867,847

[45] Date of Patent: Feb. 9, 1999

[54] HEIGHT ADJUSTABLE SINK AND VANITY

[75] Inventors: Barbara A. Klawitter; Wesley D. Vagle, both of Burnsville, Minn.

[73] Assignee: BJ Industries, Inc., Burnsville, Minn.

[21] Appl. No.: 843,244

[22] Filed: Apr. 14, 1997

[51] Int. Cl.[6] ..... A47K 1/05

[52] U.S. Cl. ..... 4/645; 312/247

[58] Field of Search ..... 4/645; 312/247, 312/298

[56] References Cited

U.S. PATENT DOCUMENTS

| | | | |
|---|---|---|---|
| 717,533 | 1/1903 | Brandt | 4/645 |
| 1,385,262 | 7/1921 | Nebel | 4/645 |
| 1,391,091 | 9/1921 | Arbuckle | 4/645 X |
| 1,406,426 | 2/1922 | Stewart | 4/645 |
| 1,864,184 | 6/1932 | Cavert | 4/645 |
| 2,716,757 | 9/1955 | Eriksson | 4/645 |
| 2,817,094 | 12/1957 | Lessley | 4/645 |
| 2,958,871 | 11/1960 | Eskenazi et al. | 4/645 |
| 3,011,177 | 12/1961 | Haughey | 4/645 |
| 3,118,147 | 1/1964 | Larkin | 4/645 |
| 3,456,264 | 7/1969 | Flagg | 4/645 |
| 3,473,173 | 10/1969 | Maciulaitis et al. | 4/645 X |
| 3,486,175 | 12/1969 | Schwartz | 4/645 |
| 4,233,693 | 11/1980 | Stocklöw | 4/644 |
| 4,328,597 | 5/1982 | Bodin | 4/644 |
| 4,497,511 | 2/1985 | Barker | 285/158 |
| 4,807,834 | 2/1989 | Cohen | 244/159 |
| 5,050,253 | 9/1991 | Wasek | 4/645 |
| 5,160,174 | 11/1992 | Thompson | 285/32 |
| 5,230,109 | 7/1993 | Zaccai et al. | 4/645 |

*Primary Examiner*—Robert M. Fetsuga
*Attorney, Agent, or Firm*—Chad A. Klingbeil

[57] ABSTRACT

The height adjustable sink and vanity includes a fixed base portion that preferably includes two doors on the front that swing open to the sides. The cabinet is freestanding, but has no supporting surfaces on the front portion. The sink and countertop are vertically adjustable as a unit, with a standpipe below the sink that easily accommodates the adjustability. Projecting downward from the right and left edges of the countertop are panels that help prevent fingers and other objects from being pinched between the adjustable countertop portion and an adjacent, fixed surface. A remote control unit may be located on the end of a cord connected to a small electric motor that moves the unit up and down, depending on the selection made on the remote control unit.

24 Claims, 5 Drawing Sheets

HEIGHT ADJUSTABLE SINK AND VANITY

BACKGROUND OF THE INVENTION

1. Technical Field

The present invention relates generally to sinks and vanities to which the sinks are attached that may be vertically adjusted. In particular, the invention relates primarily to the drain pipe from the sink that permits of the vertical adjustability.

2. Background Information

There are several situations where it is desirable to be able to adjust a kitchen sink or bathroom basin in a vertical orientation. This is especially true in a home or institution where the sink or basin is used by people of varying heights or limited physical abilities. Obviously, the scene of a child standing on his or her tiptoes trying to reach the water faucet is a familiar one to those with families having small children. Perhaps less familiar but even more problematic are those situations where the sink or basin is used both by able-bodied people and also those with certain physical challenges. In particular, senior citizens who are restricted to a wheelchair may find it extremely inconvenient, if not impossible, to reach the faucet of a sink or basin that is intended to accommodate an able-bodied person of average adult height.

Others have tried to accomplish the task of providing a sink and vanity combination that is height adjustable. A number of problems accompany this endeavor, however, not least of which is the need for a drain pipe that meets the building code of most localities and is not prohibitively expensive. Also important, however, especially when considering an adjustable vanity, is a The height adjustable sink and vanity of the present invention overcomes difficulties described above and affords other features and advantages heretofore not available.

SUMMARY OF THE INVENTION

The height adjustable sink and vanity includes a fixed base portion that preferably includes two doors on the front that swing open to the sides. The cabinet is freestanding, but has no supporting surfaces on the front portion. The sink and countertop are vertically adjustable as a unit, with a standpipe below the sink that easily accommodates the adjustability. Projecting downward from the right and left edges of the countertop are panels that help prevent fingers and other objects from being pinched between the adjustable countertop portion and an adjacent, fixed surface. A remote control unit may be located on the end of a cord connected to a small electric motor that moves the unit up and down, depending on the selection made on the remote control unit.

It is an object of this invention to provide a sink and countertop unit that are easily moved up and down to accommodate users of various heights and physical abilities. It is a further object of this invention to provide a cabinet usable with a height adjustable sink that permits convenient positioning of a wheelchair or similar device for assisting the mobility of a person adjacent the sink to permit easy access to the sink by that person.

It is also an object of this invention to make this unit easy to use, while still having an attractive appearance. It is a further object of this invention to ensure that it meets applicable building codes, is safe and reliable.

Other objects and advantages of the invention will become apparent from the following detailed description and from the appended drawings in which like numbers have been used to describe like parts throughout the several views.

DESCRIPTION OF THE PREFERRED EMBODIMENT

Figure 1:
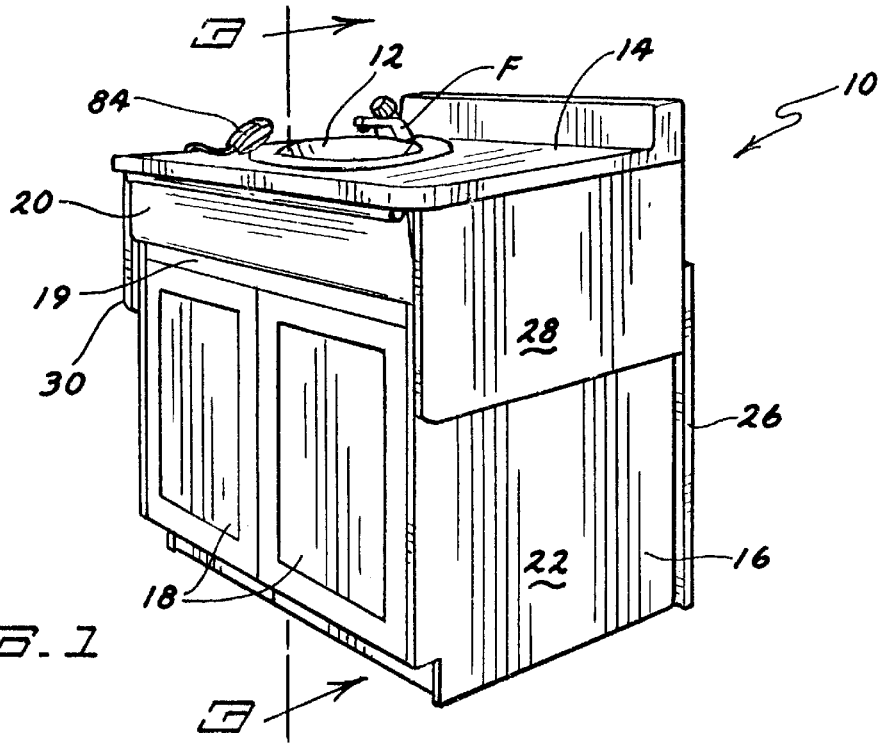
FIG. 1 is a perspective view of the present invention, showing the sink in the fully elevated position.
Figure 2:
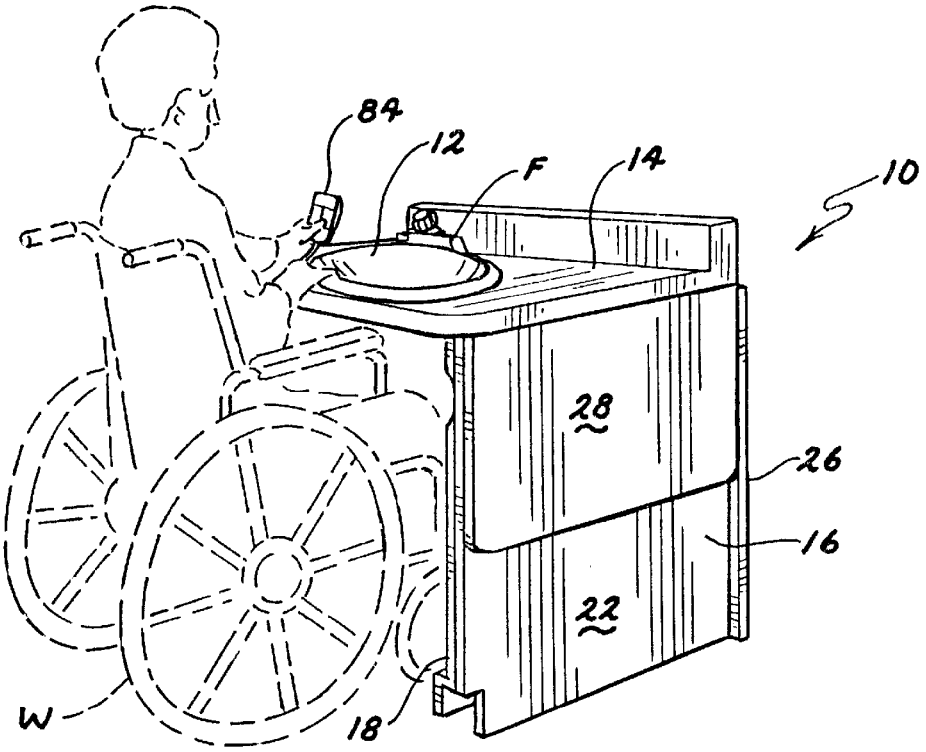
FIG. 2 is a perspective view similar to FIG. 1, showing the sink in the fully lowered position.
Figure 8:
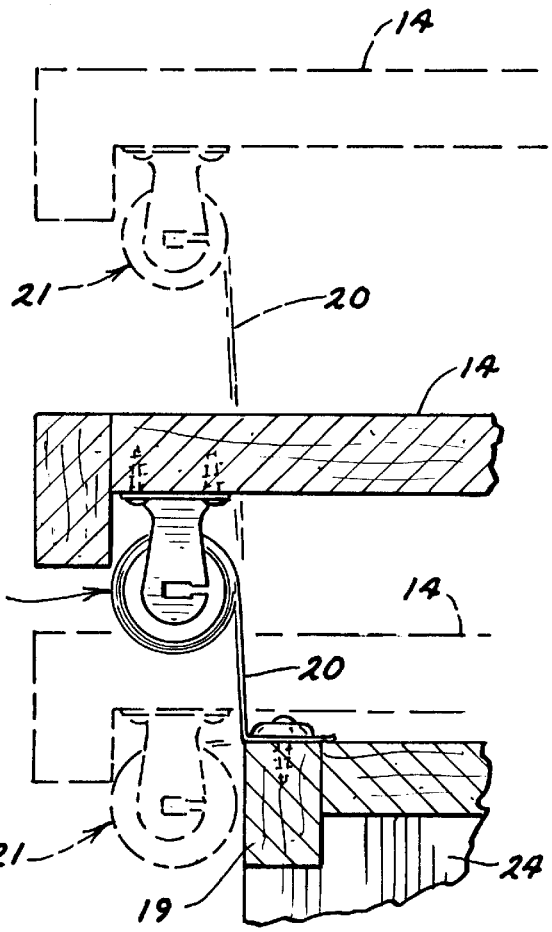
FIG. 8 is an end view of the front roller assembly showing the countertop in various stages of elevation.
Figure 9:
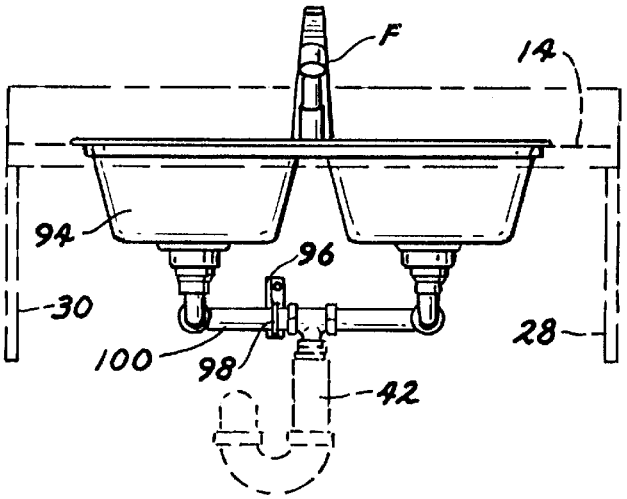
FIG. 9 is a front view of an alternate embodiment of the invention, showing a double basin sink.
Figure 10:
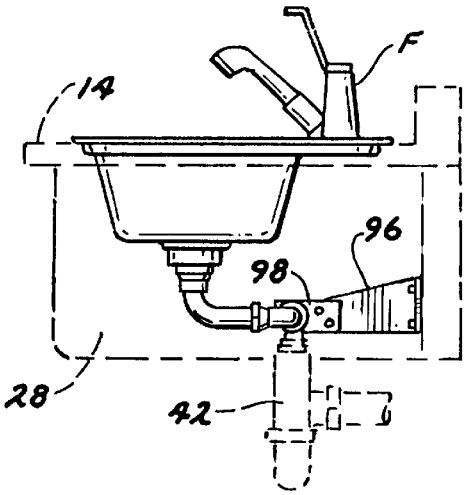
FIG. 10 is a side view of the double basin sink embodiment shown in FIG. 9.

With reference to the drawings, and in particular to FIGS. 1 and 2, the height adjustable vanity of the present invention is generally indicated by reference numeral 10. The unit preferably includes a single basin sink 12 having a faucet F, a countertop 14 and a lower cabinet 16 comprising a base portion, although a multiple compartment sink such as a kitchen sink may also easily be accommodated, as shown in FIGS. 9 and 10. Cabinet 16 preferably includes two doors 18. As shown in FIG. 2, doors 18 open to the sides, and preferably within the area defined by cabinet 16, to accommodate a person in a wheelchair W. A cross piece 19 extends across the top of the opening defined by doors 18, fixedly attached on its ends to walls 22, 24. Extending between the bottom of countertop 14 and cross piece 19 is a roller shade 20. As shown in FIG. 8, a spool assembly 21 of roller shade 20 is attached to the bottom of countertop 14, and the opposite end of roller shade 20 is attached to the top of cross piece 19.

Figure 3:
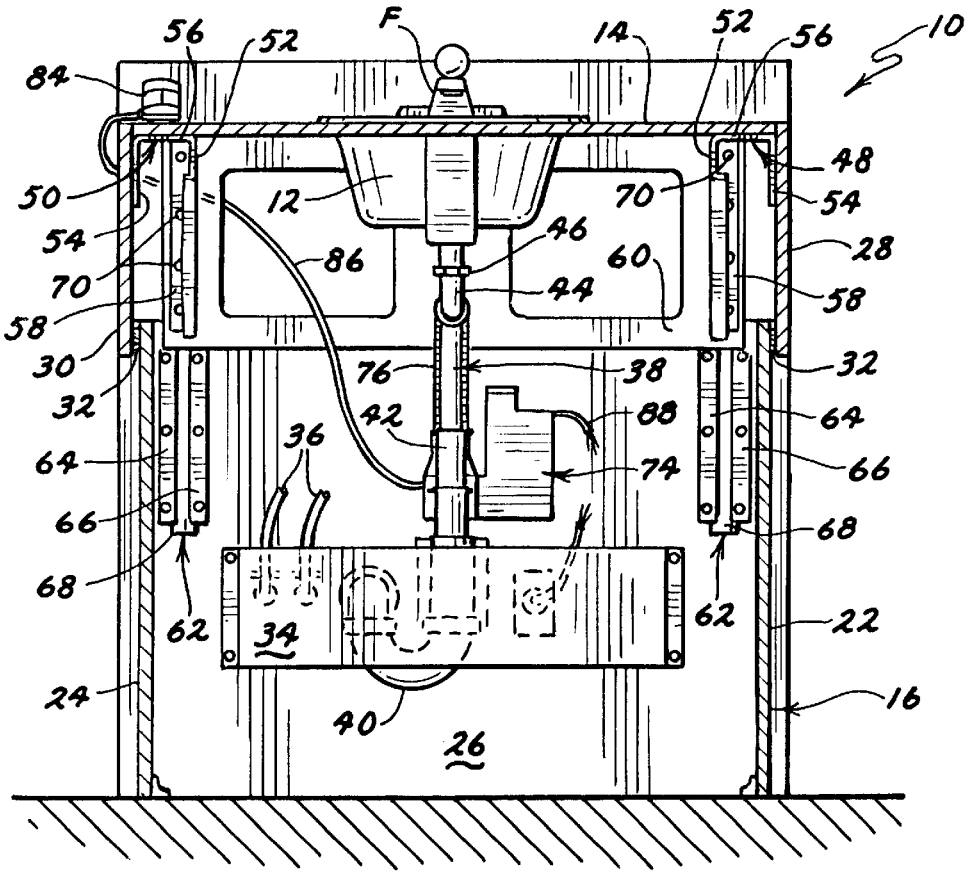
FIG. 3 is a front section view taken along line 3—3 of FIG. 1, showing the sink in the fully elevated position.
Figure 4:
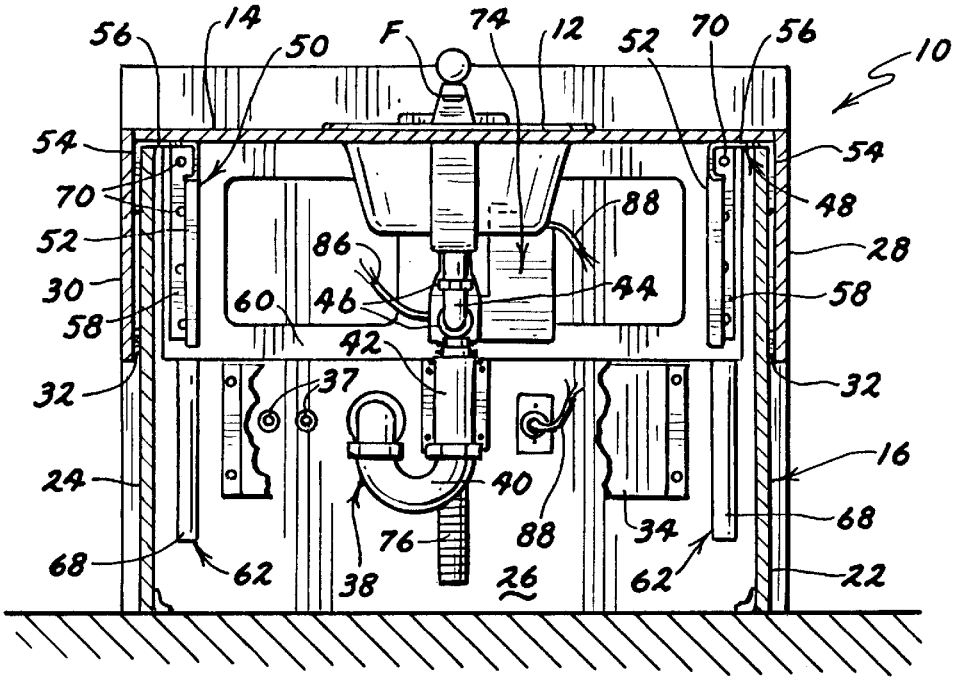
FIG. 4 is a front section view similar to FIG. 3, showing the sink in the fully lowered position.

Referring to FIGS. 3 and 4, it may be seen that cabinet 16 includes a right wall 22, a left wall 24 and a rear wall 26. In addition, as may also be seen in FIGS. 1 and 2, downwardly depending from and fixedly attached to the ends of countertop 14 are right and left side drop panels 28, 30, respectively. Right side drop panel 28 overlies right wall 22 of cabinet 16, and left side drop panel 30 overlies left wall 24 of cabinet 16. Side drop panels 28, 30 are maintained in a spaced, sliding relationship with walls 24, 26, respectively, by spacers 32.

All supply and drain plumbing is protected by a shroud 34 attached to and projecting from rear wall 26. Shroud 34 protects the supply and drain plumbing from the hardware attached to wheelchair W, and protects the legs of the person using wheelchair W from the plumbing supply and drain lines. The protected plumbing includes hot and cold water supply lines 36, which pass through rear wall 26 at openings 37 and lead to faucet F, and drain assembly 38, including P-trap 40 and height adjustable standpipe 42. Water supply lines 36 are preferably made of flexible tubing that complies with local building code requirements. The preferred construction of height adjustable standpipe 42 is disclosed in the copending application Ser. No. 08/811,832 , filed Mar. 5, 1997, which application is incorporated by reference herein. Drain assembly 38 also preferably includes a setback portion comprising an elbow 44 that connects the top of height adjustable standpipe 42 to the drain outlet fixture of sink 12, preferably using threaded slipnuts 46. The use of elbow 44 between the drain outlet of sink 12 and height adjustable standpipe 42 helps to accommodate the legs of a handicapped person, using a wheelchair W, within the space of cabinet 16 beneath sink 12. The outlet end of drain assembly 38 connects to a waste assembly which in turn communicates directly with a sewage disposal system.

Raising and lowering of countertop 14, to which sink 12 is attached, is accomplished by the raising and lowering of support members to which countertop 14 is attached. These support members include support means which comprise right and left support brackets 48, 50, respectively, to which countertop 14 is attached. Support brackets 48, 50 each include an inner wall 52, an outer wall 54 generally parallel to inner wall 52, and an upper wall 56 extending between inner wall 52 and outer wall 54. As shown in FIGS. 3 and 4, outer walls 54 of support brackets 48, 50 are attached to inner surfaces of right and left side drop panels, 28, 30, respectively, and upper wall 56 of support brackets 48, 50 are attached to the bottom surface of countertop 14. Additionally, support brackets 48, 50 are attached along rear flanges 58, extending from inner walls 52, to a lift plate 60, as more clearly illustrated in FIG. 7.

Figure 7:
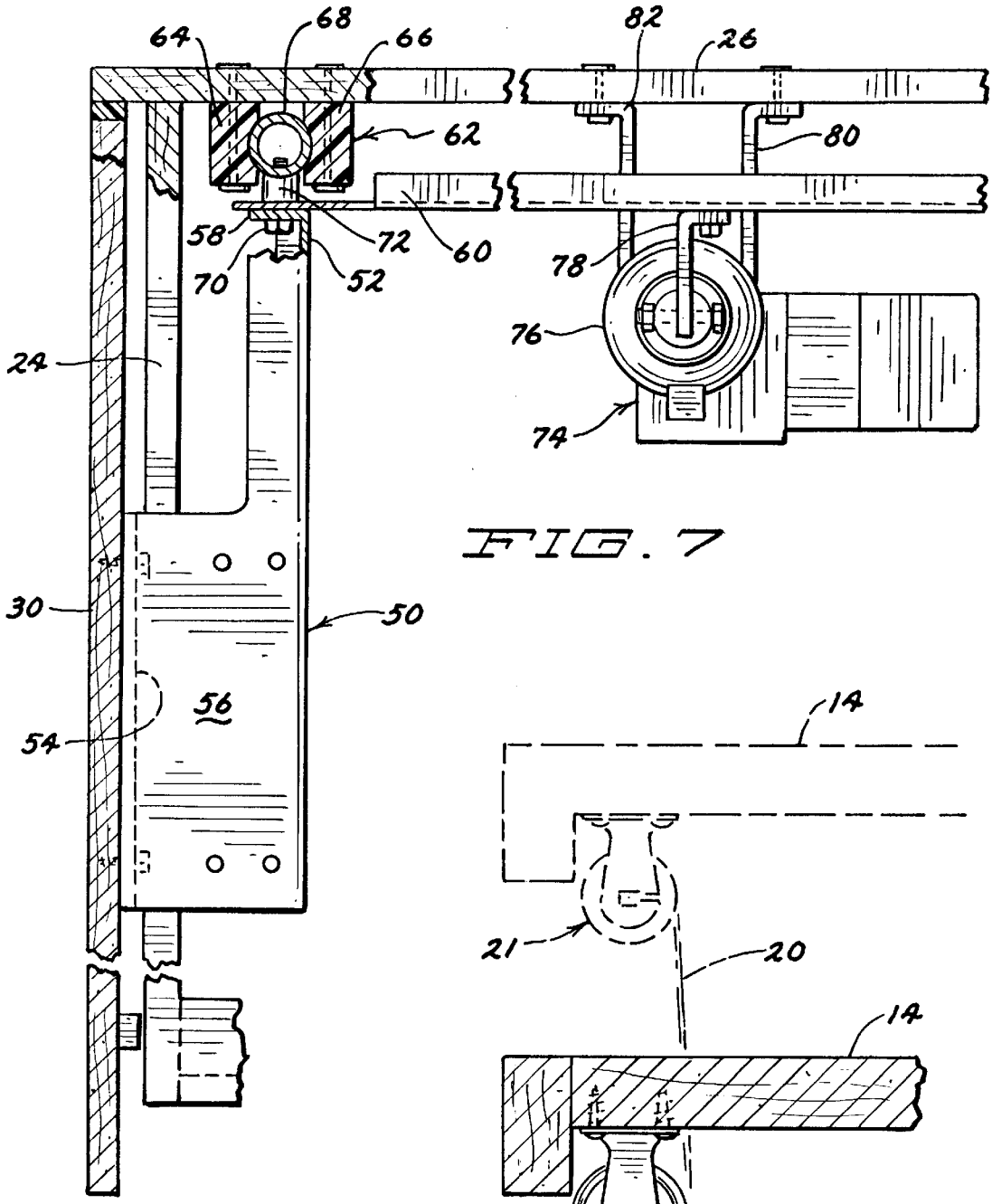
FIG. 7 is a top sectional view of the countertop support members that enable raising and lowering of the sink.

To raise and lower sink 12 and countertop 14, and all attached components, adjustable attachment means are provided that include lift guide assemblies 62. Lift plate 60 is attached, as shown in FIG. 7, to first and second lift guide assemblies 62. Each lift guide assembly 62 includes left and right lift guides 64, 66, respectively, fixedly attached to rear wall 26, and a lift shaft 68. Lift shaft 68 is attached to lift plate 60 with screws 70 that pass through spacers 72. Screws 70 also pass through holes in rear flange 58 of support brackets 48, 50 for retaining support brackets 48, 50 to lift plate 60.

As also shown in FIG. 7, raising and lowering of sink 12 is actuated by an electric motor assembly 74, preferably a MULTIMAT motor model number 001.061.039, manufactured by Dewert Motorized Systems of Frederick, Md. Height adjustment means are provided by electric motor assembly 74 which includes a screw drive member 76 that is attached to lift plate 60 through engagement with a lift bracket 78 that is fixedly thereto. Electric motor assembly 74 is retained in position by right and left motor brackets 80, 82, respectively, that are fixedly attached to rear wall 26. Electric motor assembly 74 is actuated by a pendant switch 84, attached thereto by cable 86, for raising and lowering sink 12. Pendant switch 84 preferably includes up and down buttons, not shown, for controlling the direction of motion of sink 12. Electric motor assembly 74 is powered by electricity received through power cord 88.

Figure 6:
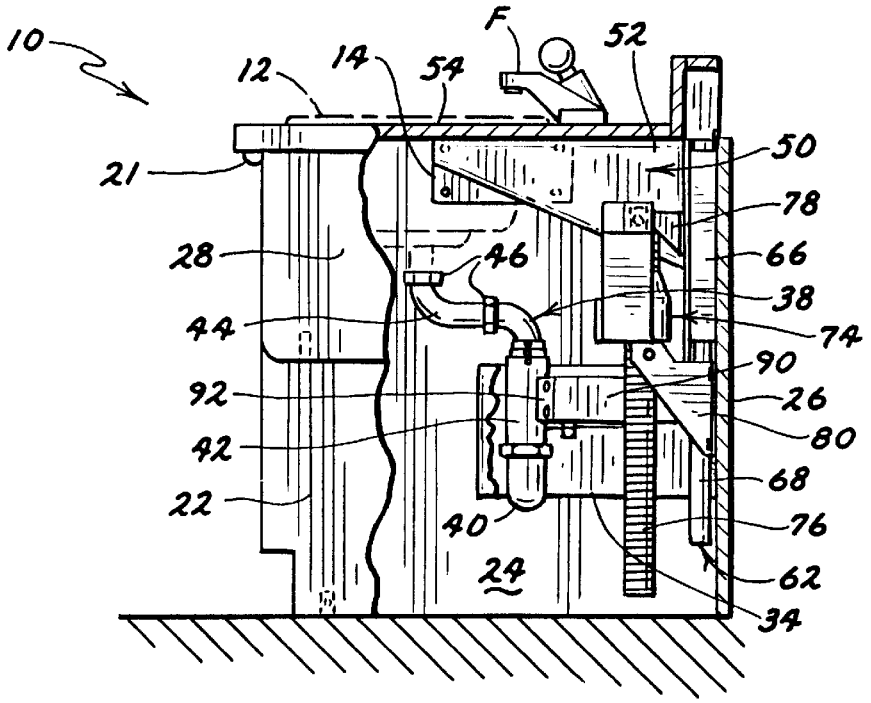
FIG. 6 is a side cutaway view similar to FIG. 5, showing the sink in the fully lowered position.

Referring to FIG. 6, drain assembly is supported in position by plumbing support bracket 90. Plumbing support bracket 90 preferably is connected to left motor bracket 82 by screws (not shown), and includes a V-shaped portion 92 against which height adjustable standpipe 42 may bear for support during use of vanity 10.

As shown in FIGS. 9 and 10, when a multiple compartment sink 94 is used with height adjustable vanity 10, it is preferred to include a plumbing support bracket 96 therewith, which is attachable to lift plate 60. To the end of plumbing lift bracket 96 is attached a plumbing capture bracket 98, having an aperture through which passes a horizontal drain component 100. As with plumbing support bracket 90, plumbing lift bracket 96 provides added support for the drain assembly 38 during use of vanity 10.

Figure 11:
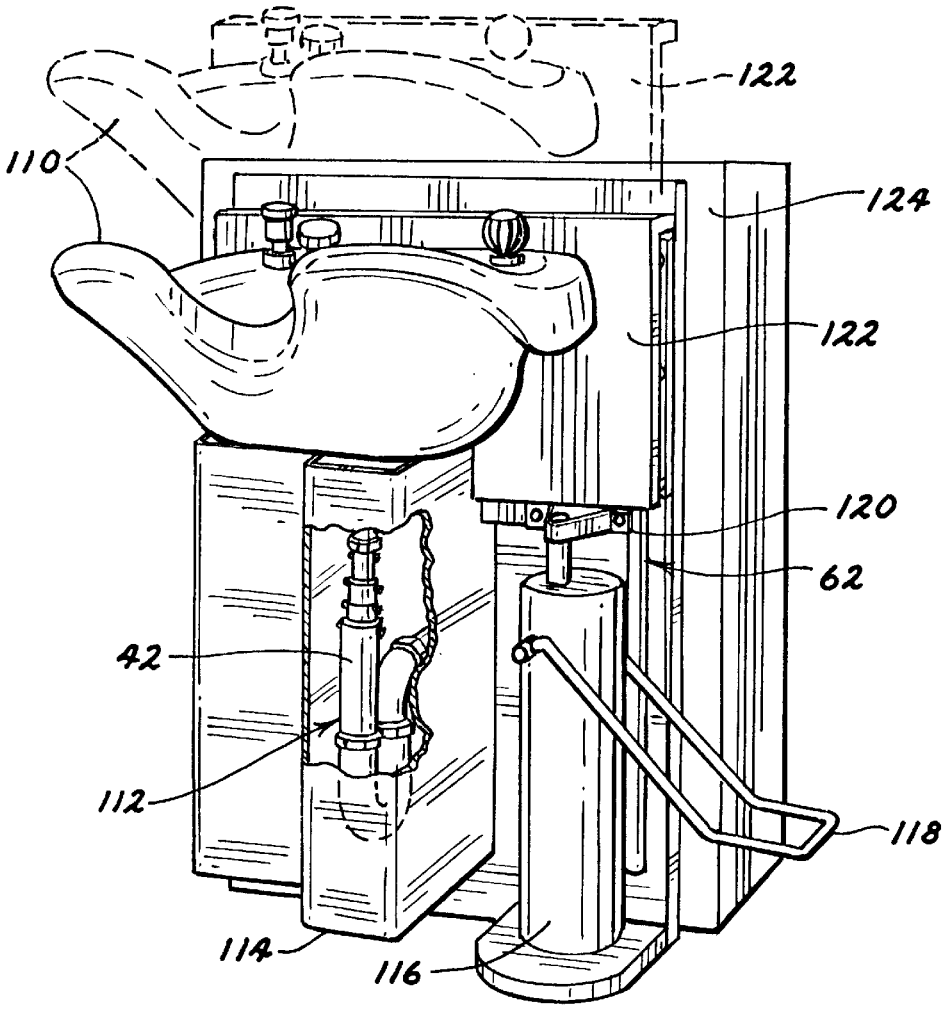
FIG. 11 is a perspective view of a manually actuated embodiment of the present invention, shown with a shampoo bowl.

FIG. 11 illustrates use of a shampoo basin 110 with height adjustable standpipe 42. Here, height adjustable standpipe 42 is incorporated into a drain assembly 112 which is surrounded by a shroud 114. A manually actuated lift assembly 116, controlled by foot pedal 118, is attached by bracket 120 to lift plate 122, to which shampoo basin 110 is mounted. A suitable manually actuated lift assembly 116 is available from Highland Machine of Highland, Ill. Lift plate 122 is preferably slidably attached to rear wall 124 as by lift guide assemblies 62.

Figure 5:
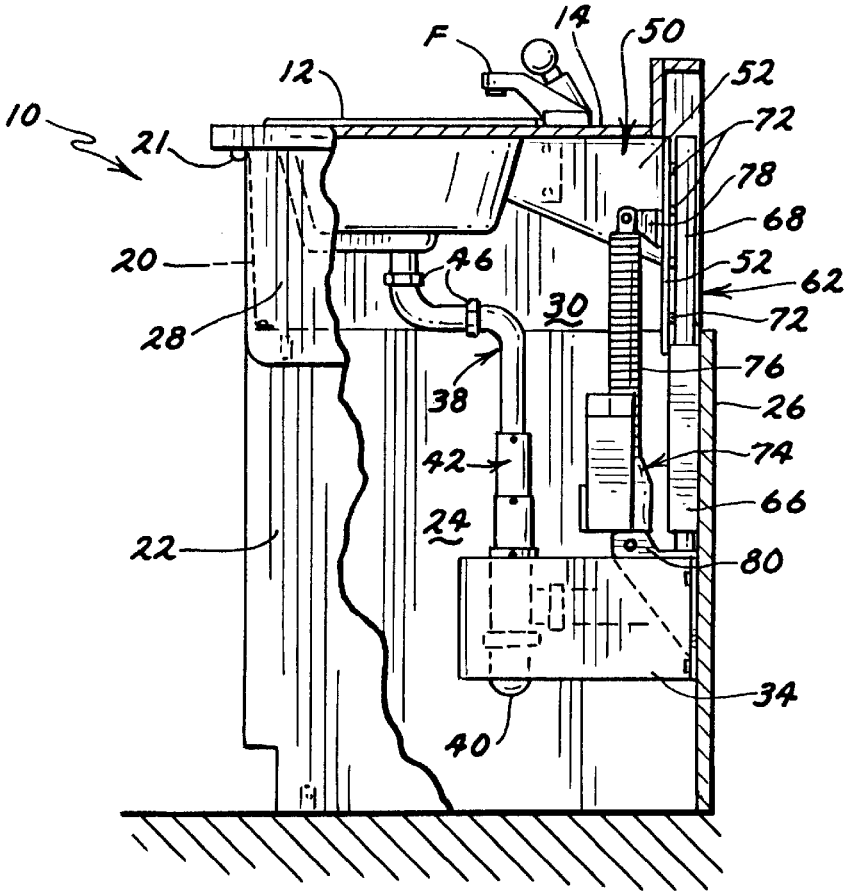
FIG. 5 is a side cutaway view showing the sink in the fully elevated position.

In use, the height adjustable vanity 10 may be used in the fully raised position illustrated in FIGS. 1, 3 and 5, the fully lowered position illustrated in FIGS. 2, 4 and 6, or in any intermediate position. Pendant switch 84 may be used to raise or lower vanity 10 to bring sink 12 and faucet F to an easily accessible position for a user of virtually any height or physical limitation. For wheelchair users, doors 18 may be opened to the sides to permit positioning of the front of wheelchair W and the legs of the user beneath countertop 14.

To raise the countertop 14 of vanity 10, the appropriate button on pendant switch 84 is selected, thereby actuating electric motor assembly 74, which in turn rotates screw drive member 76. Screw drive member 76 causes lift plate 60 to elevate, thereby raising all the components attached thereto, including countertop 14 and sink 12. Upward motion of lift plate 60 is guided by lift guide assemblies 62. As countertop 14 is raised, roller shade 20 is extended from roller shade spool assembly 21, maintaining a clean appearance on the front of vanity 10.

The steps of lowering countertop 14 of vanity 10 are initiated by selecting the alternate button on pendant switch 84. Screw drive member 76 rotates in the opposite direction when lowering countertop 14, resulting in controlled downward movement thereof. As countertop 14 is lowered, roller shade 20 is rewound onto roller shade spool assembly 21, helping to prevent fingers and hands from being pinched between countertop 14 and cross piece 19. Similarly, drop panels 28, 30 also help fingers and hands from being pinched between countertop 14 and the upper edges of side walls 22, 24, respectively.

When doors 18 are opened for positioning of wheelchair W beneath countertop 14, they may be swung out to the side in a conventional manner, or, preferably, sildably positioned within vanity 10 as illustrated in FIG. 2. When positioned as illustrated in FIG. 2, doors 18 are easily located in the space between inner wall 52 and outer wall 54 of right and left support brackets 48, 50, respectively. Either method of positioning doors 18 may be accomplished using conventional cabinetry techniques already well known in the trade.

While the preferred embodiments of the invention have been described, it should be understood that various changes, adaptations and modifications may be made therein without departing from the spirit of the invention and the scope of the appended claims.

What is claimed is:

1. A height adjustable vanity for adjustably positioning a sink which may be contained thereon, the sink having a drain opening with a drain fixture attached thereto for communicating with a waste assembly for draining to a sewage disposal system, the height adjustable vanity comprising:

a base portion having a rear wall;

a countertop portion for containing the sink, the countertop portion being adjustably attached to said rear wall of said base portion;

adjustable attachment means for maintaining the position of said countertop portion relative to said base portion of the vanity;

height adjustment means for vertically repositioning said countertop portion relative to said base portion; and a drain assembly including a generally vertically aligned height adjustable standpipe attached to the drain fixture of the sink, said drain assembly comprising:

first, second, third and fourth cylindrical pipe sections, each said pipe section having a first end and a second end, said first end of said first pipe section being removably attachable to the drain fixture of the sink, said second end of each said pipe section being smaller in diameter than and slidably receivable within said first end of the next adjacent said pipe section, said fourth pipe section being removably attachable to the waste assembly, each said pipe section having an inner surface and an outer surface, said first pipe section being smaller in diameter than said second pipe section, said second pipe section being smaller in diameter than said third pipe section, sand said third pipe section being smaller in diameter than said fourth pipe section, and said second end of said fourth pipe section being removably attachable to the drain assembly;

first and second cable members, each said cable member having a first end and a second end;

first and second fastening members attached to said outer surface of each said pipe section for attachment and retention of said cable members, said first and second fastening members being diametrically displaced one from another, said fastening members being attached to said respective pipe sections adjacent to said first end thereof, said first end of said first cable member being attached to said first fastening member of one said pipe section, said second end of said first cable member being attached to said second fastening member of a next said pipe section, said first end of said second cable member being attached to said second fastening member of said one pipe section, and said second end of said second cable member being attached to said first fastening member of said next pipe section, whereby upon extension of one said pipe section from a next said pipe section, said one pipe section is restrained from being fully withdrawn from said next pipe section; and gasket means between said ends of said respective pipe sections, whereby waste materials are prevented from leaking from the standpipe assembly.

2. The height adjustable vanity described in claim 1, wherein said height adjustment means comprises:

an electric motor assembly fixedly attached to said rear wall of said base portion; and extension means actuated by said electric motor assembly, said extension means being fixedly attached to said countertop portion, whereby actuation of said electric motor assembly causes said extension means to extend or retract, thereby raising or lowering said countertop portion.

3. The height adjustable vanity described in claim 2, wherein said extension means comprises a screw drive member having a top end and an intermediate portion, said screw drive member being threadedly engaged to said electric motor assembly along its said intermediate portion and having its said top end fixedly attached to said countertop portion.

4. The height adjustable vanity described in claim 3, further comprising:

a pendant switch connected to said electric motor assembly by a pendant switch cable for remotely controlling said electric motor assembly.

5. The height adjustable vanity described in claim 1, wherein said countertop portion further comprises:

countertop member to which the sink is mounted, said countertop member having a rear side, a right side and a left side; and a lift plate generally downwardly extending from said rear side of said countertop member, said lift plate having a front side and a rear side, said adjustable attachment means and said height adjustment means being attached to said lift plate.

6. The height adjustable vanity described in claim 5, wherein said height adjustment means comprises:

an electric motor assembly fixedly attached to said rear wall of said base portion; and extension means actuated by said electric motor assembly, said extension means being fixedly attached to said lift plate, whereby actuation of said electric motor assembly causes said extension means to extend or retract, thereby raising or lowering said countertop portion.

7. The height adjustable vanity described in claim 6, wherein said extension means comprises a screw drive member having a top end and an intermediate portion, said screw drive member being threadedly engaged to said electric motor assembly along its said intermediate portion and having its said top end fixedly attached to said lift plate.

8. The height adjustable vanity described in claim 5, wherein said adjustable attachment means further comprises:

lift guide means fixedly attached to said rear wall of said base portion; and lift guide engaging means fixedly attached to said lift plate.

9. The height adjustable vanity described in claim 8, wherein said lift guide means comprises first and second lift guide assemblies, said first and second lift guide assemblies being spaced one from another in a generally parallel orientation, each said lift guide assembly including a left lift guide member and a right lift guide member, said first and second lift guide assemblies being generally vertically aligned, said left and right lift guide members being generally parallel to and narrowly spaced from one another to form a channel therebetween.

10. The height adjustable vanity described in claim 9, wherein said lift guide engaging means comprises first and second lift shafts for engaging said channels formed by said first and second lift guide assemblies, respectively, said first and second lift shafts being fixedly attached to said rear side of said lift plate, said first and second lift shafts being spaced one from another in a generally parallel, generally vertical orientation.

11. The height adjustable vanity described in claim 5, further comprising:

a drain assembly support bracket having a first end and a second end, said first end thereof being fixedly attached to said rear wall of said base portion, and said second end thereof bearing against said drain assembly, whereby said drain assembly support bracket maintains said drain assembly in a generally vertical orientation, spaced apart from and generally parallel to said rear wall of said base portion.

12. The height adjustable vanity described in claim 5, wherein said drain assembly further comprises a setback portion attached to the drain portion of the sink, whereby said setback portion positions said generally vertically aligned height adjustable standpipe closer to said rear wall of said base portion.

13. The height adjustable vanity described in claim 1, wherein said second and fourth pipe sections of said height adjustable standpipe are made of PVC plastic.

14. The height adjustable vanity described in claim 13, wherein said gasket means of said height adjustable standpipe comprises:

at least one annular groove on said interior surface of said second pipe section and adjacent to said first end thereof, and at least one annular groove on said interior surface of said fourth pipe section and adjacent to said first end thereof;

an O-ring positioned in each of said at least one annular grooves on said interior surface of said second pipe section, and an O-ring positioned in each of said at least one annular grooves on said interior surface of said fourth pipe section, whereby said O-rings are fixedly retained within said interior annular grooves of said second and fourth pipe sections, respectively, and slidably engage said exterior surfaces of said first and third pipe sections, respectively;

at least one annular groove on said exterior surface of said second pipe section and adjacent to said second end thereof; and an O-ring positioned in each of said at least one annular grooves on said exterior surface of said second pipe section, whereby said O-rings are fixedly retained within said exterior annular grooves of said second pipe section and slidably engages said interior surface of said third pipe section.

15. The height adjustable vanity described in claim 5, further comprising support means for supporting said countertop member of said countertop portion in a generally horizontal alignment.

16. The height adjustable vanity described in claim 15, wherein said support means comprises right and left support brackets, said right support bracket extending between and fixedly attached to said right side of said countertop member and said front side of said lift plate, and said left support bracket extending between and fixedly attached to said left side of said countertop member and said front side of said lift plate.

17. The height adjustable vanity described in claim 16, wherein said right and left support brackets comprise:

an upper wall for attachment to said countertop member;

an outer wall downwardly depending from said upper wall;

an inner wall downwardly depending from said upper wall and spaced apart from and generally parallel to said outer wall; and a rear flange for attachment to said lift plate, said rear flange projecting from said inner wall.

18. The height adjustable vanity described in claim 17, further comprising:

right side and left side drop panels, said right side drop panel being fixedly attached to said outer wall of said right support bracket and downwardly depending from said right side of said countertop member, and said left side drop panel being fixedly attached to said outer wall of said left support bracket and downwardly depending from said left side of said countertop member.

19. The height adjustable vanity described in claim 18, wherein said base portion further comprises:

right and left side walls projecting from and fixedly attached to the right and left edges, respectively, of said rear wall of said base portion, said right side and left side drop panels overlying said right and left side walls, respectively;

a cross piece extending between and fixedly attached to the front edges of said right and left side walls, respectively, of said base portion; and a right door and a left door extending across the front of said base portion, said right and left doors hingedly attached to said base portion, said right door slidably recessable between said right side wall of said base portion and said inner wall of said right support bracket, and said left door slidably recessable between said left side wall of said base portion and said inner wall of said left support bracket.

20. The height adjustable vanity described in claim 19, further comprising:

a roller shade spool assembly fixedly attached to the front of said countertop member, said roller shade spool assembly carrying a roller shade member, said roller shade member having a first end and a second end, said first end of said roller shade member being fixedly attached to said roller shade spool assembly, and said second end of said roller shade member being fixedly attached to said cross piece of said base portion.

21. The height adjustable vanity described in claim 18, wherein said base portion further comprises:

right and left side walls projecting from and fixedly attached to the right and left edges, respectively, of said rear wall of said base portion, said right side and left side drop panels overlying said right and left side walls, respectively;

a cross piece extending between and fixedly attached to the front edges of said right and left side walls, respectively, of said base portion; and a roller shade spool assembly fixedly attached to the front of said countertop member, said roller shade spool assembly carrying a roller shade member, said roller shade member having a first end and a second end, said first end of said roller shade member being fixedly attached to said roller shade spool assembly, and said second end of said roller shade member being fixedly attached to said cross piece of said base portion.

22. The height adjustable vanity described in claim 5, wherein said base portion further comprises:

right and left side walls projecting from and fixedly attached to the right and left edges, respectively, of said rear wall of said base portion, said right side and left side drop panels overlying said right and left side walls, respectively;

a cross piece extending between and fixedly attached to the front edges of said right and left side walls, respectively, of said base portion; and a roller shade spool assembly fixedly attached to the front of said countertop member, said roller shade spool assembly carrying a roller shade member, said roller shade member having a first end and a second end, said first end of said roller shade member being fixedly attached to said roller shade spool assembly, and said second end of said roller shade member being fixedly attached to said cross piece of said base portion.

23. A height adjustable vanity for adjustably positioning a sink which may be contained thereon, the sink having a drain opening with a drain fixture attached thereto for communicating with a waste assembly for draining to a sewage disposal system, the height adjustable vanity comprising:

a base portion having a rear wall;

a countertop member to which the sink is mounted, said countertop member having a rear side, a right side and a left side;

a lift plate generally downwardly extending from said rear side of said countertop member, said lift plate having a front side and a rear side, said adjustable attachment means and said height adjustment means being attached to said lift plate;

first and second lift guide assemblies, said first and second lift guide assemblies being spaced one from another in a generally parallel orientation, each said lift guide assembly including a left lift guide member and a right lift guide member, said first and second lift guide assemblies being generally vertically aligned, said left and right lift guide members being generally parallel to and narrowly spaced from one another to form a channel therebetween;

lift guide engaging means fixedly attached to said lift plate;

height adjustment means for vertically repositioning said countertop member relative to said base portion; and a drain assembly including a generally vertically aligned height adjustable standpipe attached to the drain fixture of the sink.

24. A height adjustable vanity for adjustably positioning a sink which may be contained thereon, the sink having a drain opening with a drain fixture attached thereto for communicating with a waste assembly for draining to a sewage disposal system, the height adjustable vanity comprising:

a base portion having a rear wall;

a countertop member to which the sink is mounted, said countertop member having a rear side, a right side and a left side;

a lift plate generally downwardly extending from said rear side of said countertop member, said lift plate having a front side and a rear side, said adjustable attachment means and said height adjustment means being attached to said lift plate;

adjustable attachment means for maintaining the position of said countertop member relative to said base portion of the vanity;

height adjustment means for vertically repositioning said countertop portion relative to said base portion; and a drain assembly including a generally vertically aligned height adjustable standpipe attached to the drain fixture of the sink;

right and left support brackets, said right support bracket extending between and fixedly attached to said right side of said countertop member and said front side of said lift plate, and said left support bracket extending between and fixedly attached to said left side of said countertop member and said front side of said lift plate, said right and left support brackets comprising:

(a) an upper wall for attachment to said countertop member;

(b) an outer wall downwardly depending from said upper wall;

(c) an inner wall downwardly depending from said upper wall and spaced apart from and generally parallel to said outer wall; and (d) a rear flange for attachment to said lift plate, said rear flange projecting from said inner wall;

right side and left side drop panels, said right side drop panel being fixedly attached to said outer wall of said right support bracket and downwardly depending from said right side of said countertop member, and said left side drop panel being fixedly attached to said outer wall of said left support bracket and downwardly depending from said left side of said countertop member;

right and left side walls projecting from and fixedly attached to the right and left edges, respectively, of said rear wall of said base portion, said right side and left side drop panels overlying said right and left side walls, respectively;

a cross piece extending between and fixedly attached to the front edges of said right and left side walls, respectively, of said base portion; and a right door and a left door extending across the front of said base portion, said right and left doors hingedly attached to said base portion, said right door slidably recessable between said right side wall of said base portion and said inner wall of said right support bracket, and said left door slidably recessable between said left side wall of said base portion and said inner wall of said left support bracket.

* * * * *